US009314675B2

(12) United States Patent
Quan

(10) Patent No.: US 9,314,675 B2
(45) **Date of Patent: *Apr. 19, 2016**

(54) GOLF CLUB HEAD HAVING A NANOCRYSTALLINE TITANIUM ALLOY

(71) Applicant: Karsten Manufacturing Corporation, Phoenix, AZ (US)

(72) Inventor: Liang Quan, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/486,406

(22) Filed: Sep. 15, 2014

(65) Prior Publication Data

US 2015/0005098 A1 Jan. 1, 2015

Related U.S. Application Data

(63) Continuation of application No. 13/667,117, filed on Nov. 2, 2012, now Pat. No. 8,852,024.

(51) Int. Cl.
*A63B 53/04* (2015.01)

(52) U.S. Cl.
CPC ..... *A63B 53/04* (2013.01); *A63B 53/047* (2013.01); *A63B 53/0466* (2013.01); *A63B 53/0487* (2013.01); *A63B 2209/00* (2013.01); *Y10T 29/49* (2015.01)

(58) Field of Classification Search
CPC ..... A63B 53/04
See application file for complete search history.

(56) References Cited

U.S. PATENT DOCUMENTS

| | | | | |
|---|---|---|---|---|
| 5,236,032 | A | 8/1993 | Nukami et al. | |
| 6,106,410 | A | 8/2000 | Glod et al. | |
| 6,200,685 | B1 | 3/2001 | Davidson | |
| 6,929,566 | B2 | 8/2005 | Sano | |
| 7,191,630 | B2 | 3/2007 | Segal | |
| 2003/0050134 | A1 * | 3/2003 | Iwata | A63B 53/04 473/349 |
| 2008/0245447 | A1 | 10/2008 | Birol et al. | |
| 2009/0029796 | A1 | 1/2009 | Mergy et al. | |
| 2009/0312118 | A1 | 12/2009 | Deshmukh et al. | |
| 2010/0234133 | A1 | 9/2010 | Chen et al. | |
| 2011/0039636 | A1 * | 2/2011 | Cackett | A63B 53/0466 473/342 |
| 2012/0135819 | A1 | 5/2012 | Uetz et al. | |
| 2013/0225320 | A1 | 8/2013 | Woolley et al. | |

OTHER PUBLICATIONS

International Search Report and Written Opinion from the International Searching Authority for related International Application No. PCT/US2013/064814 dated Mar. 6, 2014 (11 pages).
International Preliminary Report on Patentability and Written Opinion for Application No. PCT/US2013/064814 dated May 5, 2015 (7 pages).

* cited by examiner

*Primary Examiner* — Michael Dennis

(57) ABSTRACT

Embodiments of a golf club head and methods to manufacture such a golf club head are generally described herein. The golf club head generally includes at least one ball-striking face, which comprises a titanium alloy that is associated with an average grain size measuring no more than about 1 micron (μm) in the longest dimension. The golf club head is associated with a coefficient of restitution of about 0.847 or more when a ball impacts the ball-striking face.

2 Claims, 4 Drawing Sheets

GOLF CLUB HEAD HAVING A NANOCRYSTALLINE TITANIUM ALLOY

CROSS-REFERENCE TO RELATED APPLICATIONS

This is a continuation of U.S. patent application Ser. No. 13/667,117, filed on Nov. 2, 2012, the entire contents of which are fully incorporated herein by reference.

FIELD

The present disclosure relates to a club head having a ball-striking face that comprises a nanocrystalline titanium alloy, and in particular a golf club head.

BACKGROUND

In several types of sports, such as golf, hockey, baseball, softball, tee ball, and cricket, an individual may use a club with a ball-striking face to strike an object such as a ball. In use, the ball-striking face impacts the ball, thereby transferring energy from the club head to the ball. The performance of a club may be determined for example by the ball speed after the impact for a given incident ball speed. Several factors may affect the performance of a club, such as the weight distribution of the club material, the thickness of the ball-striking face, or both.

For each sport, a variety of clubs may be used, and each club may be made from a variety of materials. In particular, golf clubs may include a driver-type golf club, a fairway wood-type golf club, a hybrid-type golf club, an iron-type golf club, a wedge-type golf club, and a putter-type golf club. In referring to golf clubs, the terms "wood-type" and "iron-type" are based on tradition, indicating the type of material originally used to make the respective golf club. Modern golf clubs, however, may be manufactured from a variety of materials such as steel, titanium alloys, aluminum alloys, or composite materials.

For enhancing the performance of a golf club (e.g., a driver-type golf club), a thin ball-striking face on a club head may be desirable. A ball-striking face with a reduced thickness may bend more, which may increase the ball speed after impact. A material with a high yield strength and low modulus compared to other materials may reduce a thickness of the ball-striking face so that discretionary weight may be redistributed to other portions of a club head.

BRIEF DESCRIPTION OF THE DRAWINGS

Corresponding reference characters indicate corresponding elements among the various views of the drawings. The headings used in the figures should not be interpreted to limit the scope of the claims.

DESCRIPTION

As described herein, golf club heads are configured to comprise a nanocrystalline titanium alloy. For example, a golf club head as described herein generally includes at least one ball-striking face, which comprises a titanium alloy that is associated with an average grain size measuring no more than about 1 μm in the longest dimension. The nanocrystalline titanium alloy may be stronger compared to other golf club head materials, which may reduce a thickness of the ball-striking face. The reduced thickness of the ball-striking face may reduce the weight of the golf club head so that discretionary weight may be suitably placed elsewhere for enhancing the performance of the golf club. Also, the reduced thickness of the ball-striking face may allow the ball-striking face to bend more to increase the ball speed after impact.

Figure 1:
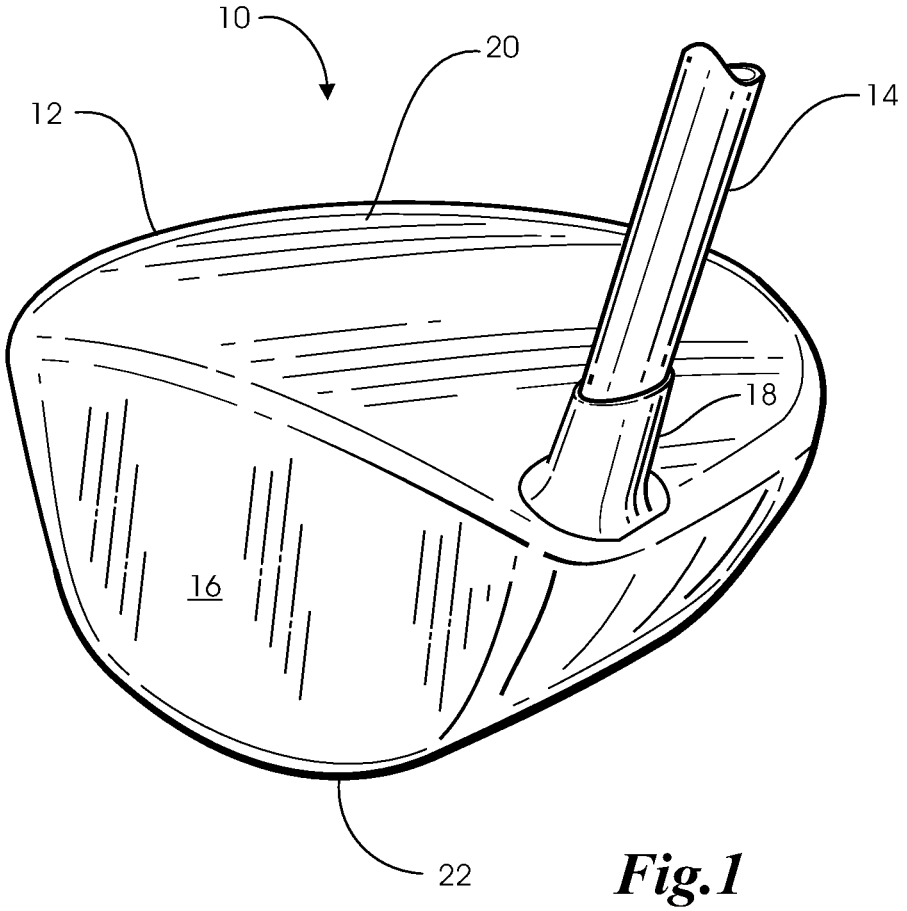
FIG. 1 is a front perspective view of a golf club head according to one embodiment of the apparatus, methods, and articles of manufacture described herein, the golf club head including a ball-striking face.

Referring to FIG. 1, for example, a golf club 10 comprises a golf club head 12 and a shaft 14 coupled thereto. The golf club head 12 includes a ball-striking face 16 that is configured and adapted for impacting a golf ball (not shown). In the illustrated embodiment, the golf club head 12 also comprises a hosel 18, which is counterbored for receiving one end of the shaft 14. Although the illustrated golf club 10 is a driver-type golf club, comprising a top portion or crown 20 and a sole 22, in other embodiments, the golf club 10 may be any other types of golf clubs. For example, in some embodiments, the golf club 10 may be a fairway wood-type golf club, an iron-type golf club, or a hybrid-type golf club. In other embodiments, the golf club 10 may be a wedge-type golf club, or a putter-type golf club having a heel and a toe which are denser than a center of the golf club head 12.

The golf club head 12 may be associated with a body volume between approximately 400 cubic centimeters (cc) to approximately 470 cc, but the golf club head 12 may comprise other volumes based on the type of club head. For instance, in one example comprising a driver head, the corresponding body volume may be up to approximately 600 cc. In some embodiments, the body volume of the golf club head 12 may be at least 400 cc, at least 410 cc, at least 420 cc, at least 430 cc, at least 440 cc, at least 450, at least 460 cc, at least 470 cc, at least 480 cc, at least 490 cc, at least 500 cc, at least 510 cc, at least 520 cc, at least 530 cc, at least 540 cc, at least 550 cc, at least 560 cc, at least 570 cc, at least 580 cc, or at least 590 cc. In further embodiments, the body volume of the golf club head 12 may be no more than 600 cc, no more than 590 cc, no more than 580 cc, no more than 570 cc, no more than 560 cc, no more than 550 cc, no more than 540 cc, no more than 530 cc, no more than 520 cc, no more than 510 cc, no more than 500 cc, no more than 490 cc, no more than 480 cc, no more than 470 cc, no more than 460 cc, no more than 450 cc, no more than 440 cc, no more than 430 cc, no more than 420 cc, or no more than 410 cc.

In another example comprising a fairway wood head, the corresponding body volume may be between approximately 130 cc to approximately 250 cc. In some embodiments, the body volume of the fairway wood head may be at least 130 cc, at least 140 cc, at least 150 cc, at least 160 cc, at least 170 cc, at least 180 cc, at least 190 cc, at least 200 cc, at least 210 cc, at least 220 cc, at least 230 cc, or at least 240 cc. In further embodiments, the body volume of the fairway wood head may be no more than 250 cc, no more than 240 cc, no more than 230 cc, no more than 220 cc, no more than 210 cc, no more than 200 cc, no more than 190 cc, no more than 180 cc, no more than 170 cc, no more than 160 cc, no more than 150 cc, or no more than 140 cc. It should be noted that some embodiments disclosed herein may conform to rules and/or standards of golf defined by various golf standard organizations, governing bodies, and/or rule establishing entities such as the United States Golf Association (USGA) and the Royal and Ancient Golf Club of St. Andrews (R&A), but the apparatus, methods, and articles of manufacture described herein are not limited in this regard.

The ball-striking face 16 of the golf club head 12 includes a nanocrystalline titanium alloy. According to one aspect, the nanocrystalline titanium alloy for the ball-striking face 16 may comprise, by weight, about 5.50% to about 6.75% aluminum, about 3.5% to about 4.5% vanadium, and the balance titanium and incidental elements and impurities. For example, the nanocrystalline titanium alloy may include, by weight, about 6% aluminum, about 4% vanadium, and the balance titanium and incidental elements and impurities. At room temperature, e.g., at about 20° C. to about 25° C., the nanocrystalline titanium alloy may include two phases: a hexagonal close-packed a phase and a body-centered cubic 13 phase. In some embodiments, depending on the usage requirements or preferences for the particular ball-striking face 16, the nanocrystalline titanium alloy may include any other composition that forms the a and 13 phases at room temperature.

In some embodiments, the nanocrystalline titanium alloy may comprise, by weight, at least 5.50% aluminum, at least 5.55% aluminum, at least 5.60% aluminum, at least 5.65% aluminum, at least 5.70% aluminum, at least 5.80% aluminum, at least 5.85% aluminum, at least 5.90% aluminum, at least 6.00% aluminum, at least 6.05% aluminum, at least 6.10% aluminum, at least 6.15% aluminum, at least 6.20% aluminum, at least 6.25% aluminum, at least 6.30% aluminum, at least 6.35% aluminum, at least 6.40% aluminum, at least 6.45% aluminum, at least 6.50% aluminum, at least 6.55% aluminum, at least 6.60% aluminum, at least 6.65% aluminum, or at least 6.70% aluminum. In further embodiments, the nanocrystalline titanium alloy comprises, by weight, no more than 6.70% aluminum, no more than 6.65% aluminum, no more than 6.60% aluminum, no more than 6.55% aluminum, no more than 6.50% aluminum, no more than 6.45% aluminum, no more than 6.40% aluminum, no more than 6.35% aluminum, no more than 6.30% aluminum, no more than 6.25% aluminum, no more than 6.20% aluminum, no more than 6.15% aluminum, no more than 6.05% aluminum, no more than 6.00% aluminum, no more than 5.95% aluminum, no more than 5.90% aluminum, no more than 5.85% aluminum, no more than 5.80% aluminum, no more than 5.75% aluminum, no more than 5.70% aluminum, no more than 5.65% aluminum, no more than 5.60% aluminum, or no more than 5.55% aluminum.

In some embodiments, the nanocrystalline titanium alloy may comprise, by weight, at least 3.5% vanadium, at least 3.6% vanadium, at least 3.7% vanadium, at least 3.8% vanadium, at least 3.9% vanadium, at least 4.0% vanadium, at least 4.1% vanadium, at least 4.2% vanadium, at least 4.3% vanadium, or at least 4.4% vanadium. In further embodiments, the nanocrystalline titanium alloy may comprise, by weight, no more than 4.5% vanadium, no more than 4.4% vanadium, no more than 4.3% vanadium, no more than 4.2% vanadium, no more than 4.1% vanadium, no more than 4.0% vanadium, no more than 3.9% vanadium, no more than 3.8% vanadium, no more than 3.7% vanadium, or no more than 3.6% vanadium.

Incidental elements and impurities may be present in the nanocrystalline titanium alloys disclosed herein in amounts totaling no more than 0.25%, no more than 0.24%, no more than 0.23%, no more than 0.22%, no more than 0.21%, no more than 0.20%, no more than 0.19%, no more than 0.18%, no more than 0.17%, no more than 0.16%, no more than 0.15%, no more than 0.14%, no more than 0.13%, no more than 0.12%, no more than 0.11%, no more than 0.10%, no more than 0.09%, no more than 0.08%, no more than 0.07%, no more than 0.06%, no more than 0.05%, no more than 0.04%, no more than 0.03%, no more than 0.02%, or no more than 0.01%.

In some embodiments, the nanocrystalline titanium alloy may comprise, by weight, at least 88.5% titanium, at least 88.6% titanium, at least 88.7% titanium, at least 88.8% titanium, at least 88.9% titanium, at least 89.0% titanium, at least 89.1% titanium, at least 89.2% titanium, at least 89.3% titanium, at least 89.4% titanium, at least 89.5% titanium, at least 89.6% titanium, at least 89.7% titanium, at least 89.8% titanium, at least 89.9% titanium, at least 90.0% titanium, at least 90.1% titanium, at least 90.2% titanium, at least 90.3% titanium, at least 90.4% titanium, at least 90.5% titanium, at least 90.6% titanium, at least 90.7% titanium, at least 90.8% titanium, or at least 90.9% titanium. In further embodiments, the nanocrystalline titanium alloy may comprise, by weight, no more than 91.0% titanium, no more than 89.9% titanium, no more than 89.8% titanium, no more than 89.7% titanium, no more than 89.6% titanium, no more than 89.5% titanium, no more than 89.4% titanium, no more than 89.3% titanium, no more than 89.2% titanium, no more than 89.1% titanium, no more than 89.0% titanium, no more than 89.9% titanium, no more than 89.8% titanium, no more than 89.7% titanium, no more than 89.6% titanium, no more than 89.5% titanium, no more than 89.4% titanium, no more than 89.3% titanium, no more than 89.2% titanium, no more than 89.1% titanium, no more than 89.0% titanium, no more than 88.9% titanium, no more than 88.8% titanium, no more than 88.7% titanium, or no more than 88.6% titanium.

According to one aspect, the nanocrystalline titanium alloy may comprise, by weight, about 5.5% to about 6.5% aluminum, about 1.8% to about 2.2% tin, about 3.6% to about 4.4% zirconium, about 1.8% to about 2.2% molybdenum, and the balance titanium and incidental elements and impurities. In particular, the nanocrystalline titanium alloy may comprise, by weight, about 6% aluminum, about 2% tin, about 4% zirconium, about 2% molybdenum, and the balance titanium and incidental elements and impurities. At room temperature, the nanocrystalline titanium alloy forms predominantly or primarily the a phase. In some embodiments, depending on the usage requirements or preferences for the particular ball-striking face 16, the nanocrystalline titanium alloy may include any other composition that forms predominantly or primarily the a phase at room temperature.

In some embodiments, the nanocrystalline titanium alloy may comprise, by weight, at least 5.5% aluminum, at least 5.6% aluminum, at least 5.7% aluminum, at least 5.8% aluminum, at least 5.9% aluminum, at least 6.0% aluminum, at least 6.1% aluminum, at least 6.2% aluminum, at least 6.3% aluminum, or at least 6.4% aluminum. In further embodiments, the nanocrystalline titanium alloy may comprise, by weight, no more than 6.5% aluminum, no more than 6.4% aluminum, no more than 6.3% aluminum, no more than 6.2% aluminum, no more than 6.1% aluminum, no more than 6.0% aluminum, no more than 5.9% aluminum, no more than 5.8% aluminum, no more than 5.7% aluminum, or no more than 5.6% aluminum.

In some embodiments, the nanocrystalline titanium alloy may comprise, by weight, at least 1.8% tin, at least 1.9% tin, at least 2.0% tin, or at least 2.1% tin. In further embodiments, the nanocrystalline titanium alloy may comprise, by weight, no more than 2.2% tin, no more than 2.1% tin, no more than 2.0% tin, no more than or 1.9% tin.

In some embodiments, the nanocrystalline titanium alloy may comprise, by weight, at least 3.6% zirconium, at least 3.7% zirconium, at least 3.8% zirconium, at least 3.9% zirconium, at least 4.0% zirconium, at least 4.1% zirconium, at least 4.2% zirconium, or at least 4.3% zirconium. In further embodiments, the nanocrystalline titanium alloy comprises no more than 4.4% zirconium, no more than 4.3% zirconium, no more than 4.2% zirconium, no more than 4.1% zirconium, no more than 4.0% zirconium, no more than 3.9% zirconium, no more than 3.8% zirconium, or no more than 3.7% zirconium.

In some embodiments, the nanocrystalline titanium alloy may comprise, by weight, at least 1.8% molybdenum, at least 1.9% molybdenum, at least 2.0% molybdenum, at least or 2.1% molybdenum. In further embodiments, the nanocrystalline titanium alloy comprises, by weight, no more than 2.2% molybdenum, no more than 2.1% molybdenum, no more than 2.0% molybdenum, or no more than 1.9% molybdenum.

The content of incidental elements and impurities in the nanocrystalline titanium alloys may affect the properties and performance of the ball-striking face 16. Generally, the higher the content of incidental elements and impurities, the lower the strength and the higher the modulus of the nanocrystalline titanium alloy. As explained below, a lower strength and higher modulus can decrease the performance of the ball-striking face 16, e.g., the coefficient of restitution (also referred to as "CoR"), all else being equal or held constant. In some embodiments, incidental elements and impurities in the nanocrystalline titanium alloys may include oxygen, iron, hydrogen, carbon, or nitrogen, or a mixture thereof.

In some embodiments, the nanocrystalline titanium alloy may comprise, by weight, at least 84.45% titanium, at least 84.60% titanium, at least 84.75% titanium, at least 84.90% titanium, at least 85.05% titanium, at least 85.20% titanium, at least 85.35% titanium, at least 85.50% titanium, at least 85.65% titanium, at least 85.80% titanium, at least 85.95% titanium, at least 86.10% titanium, at least 86.25% titanium, at least 86.40% titanium, at least 86.55% titanium, at least 86.70% titanium, at least 86.85% titanium, at least 87.00% titanium, or at least 87.15% titanium. In further embodiments, the nanocrystalline titanium alloy may comprise, by weight, no more than 87.30% titanium, no more than 87.15% titanium, no more than 87.00% titanium, no more than 86.85% titanium, no more than 86.70% titanium, no more than 86.55% titanium, no more than 86.40% titanium, no more than 86.25% titanium, no more than 86.10% titanium, no more than 85.95% titanium, no more than 85.80% titanium, no more than 85.65% titanium, no more than 85.50% titanium, no more than 85.35% titanium, no more than 85.20% titanium, no more than 85.05% titanium, no more than 84.90% titanium, no more than 84.75% titanium, or no more than 84.60% titanium. The apparatus, methods, and articles of manufacture described herein are not limited in this regard.

Figure 2:
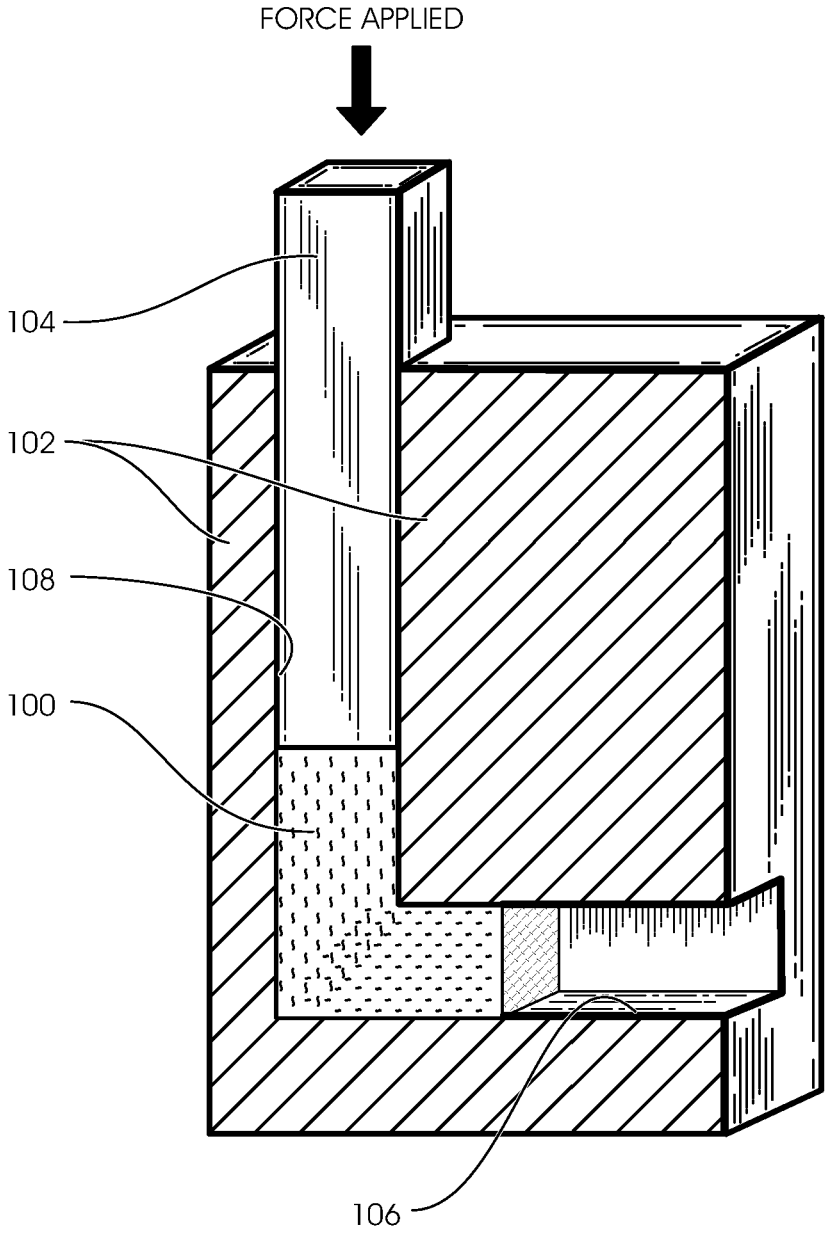
FIG. 2 is a schematic illustration of a method for manufacturing the ball-striking face of FIG. 1.

According to one aspect, the nanocrystalline titanium alloy may undergo a process to reduce the grain size. In some embodiments, the titanium alloy may be processed through an equal-channel angular pressing. Referring to FIG. 2, during this process, a billet or ingot 100 may be passed through a die 102 by a punch 104. The die 102 may contain two channels 106, 108 with a substantially equal cross-sectional area. In the illustrated construction, the two channels 106, 108 may intersect at about 90°. This process may achieve a high degree of plastic deformation in the billet 100, resulting in a substantially reduced grain size. In some embodiments, the nanocrystalline titanium alloy may undergo other suitable processes to achieve a high degree of plastic deformation in the billet 100.

In some embodiments, the nanocrystalline titanium alloy may be processed through powder metallurgy. A powder of the nanocrystalline titanium alloy may be initially formed by gas-atomizing or spray-atomizing a molten mixture of the nanocrystalline titanium alloy. The powder may then be cold- or hot-pressed into a desired shape for the ball-striking face 16. The finished part may be further annealed or heat-treated depending on the usage requirements or preferences for the particular ball-striking face 16.

According to one aspect, the nanocrystalline titanium alloy may be associated with an average grain size measuring no more than about 1 micron (μm) in the longest dimension. In some embodiments, the average grain size is at least 1 nanometer (nm), at least 10 nm, at least 20 nm, at least 30 nm, at least 40 nm, at least 50 nm, at least 100 nm, at least 150 nm, at least 200 nm, at least 250 nm, at least 300 nm, at least 350 nm, at least 400 nm, at least 450 nm, at least 500 nm, at least 550 nm, at least 600 nm, at least 650 nm, at least 700 nm, at least 750 nm, at least 800 nm, at least 850 nm, at least 900 nm, or at least 950 nm in the longest dimension. In further embodiments, the nanocrystalline titanium alloy may be associated with an average grain size measuring no more than 1 μm, no more than 950 nm, no more than 900 nm, no more than 850 nm, no more than 800 nm, no more than 750 nm, no more than 700 nm, no more than 650 nm, no more than 600 nm, no more than 550 nm, no more than 500 nm, no more than 450 nm, no more than 400 nm, no more than 350 nm, no more than 300 nm, no more than 250 nm, no more than 200 nm, no more than 150 nm, no more than 100, no more than 50 nm, no more than 40 nm, no more than 30 nm, no more than 20 nm, or no more than 10 nm in the longest dimension. As such, the nanocrystalline titanium alloy may be associated with an average grain size of 1 nm to 500 nm, 1 nm to 250 nm, or 1 nm to 50 nm in the longest dimension. The apparatus, methods, and articles of manufacture described herein are not limited in this regard.

Generally, a relatively smaller grain size may result in a higher yield strength. As explained below, a higher yield strength may enhance the performance, e.g., the coefficient of restitution, of the golf club head 12, all else being equal or held constant. According to one aspect, the nanocrystalline titanium alloy may be associated with a yield strength of about 860 Megapascal (MPa) to about 1100 MPa. By way of example only, the yield strength of a polycrystalline alloy may be calculated using the Hall-fetch relationship as follows:

$$\sigma_y = \sigma_0 + \frac{K}{\sqrt{d}} \quad [1]$$

where $\sigma_y$ is the yield strength, d is the average grain diameter, and $\sigma_0$ and K are constants for the particular material. In some embodiments, the yield strength of the nanocrystalline titanium allow may be at least 800 MPa, at least 810 MPa, at least 820 MPa, at least 830 MPa, at least 840 MPa, at least 850 MPa, at least 860 MPa, at least 870 MPa, at least 880 MPa, at least 890 MPa, at least 900 MPa, at least 910 MPa, at least 920 MPa, at least 930 MPa, at least 940 MPa, at least 950 MPa, at least 960 MPa, at least 970 MPa, at least 980 MPa, at least 990 MPa, at least 1000 MPa, at least 1010 MPa, at least 1020 MPa, at least 1030 MPa, at least 1040 MPa, at least 1050 MPa, at least 1060 MPa, at least 1070 MPa, at least 1080 MPa, or at least 1090 MPa. In further embodiments, the yield strength is no more than 1100 MPa, no more than 1090 MPa, no more than 1080 MPa, no more than 1070 MPa, no more than 1060 MPa, no more than 1050 MPa, no more than 1040 MPa, no more than 1030 MPa, no more than 1020 MPa, no more than 1010 MPa, no more than 1000 MPa, no more than 990 MPa, no more than 980 MPa, no more than 970 MPa, no more than 960 MPa, no more than 950 MPa, no more than 940 MPa, no more than 930 MPa, no more than 920 MPa, no more than 910 MPa, no more than 900 MPa, no more than 890 MPa, no more than 880 MPa, no more than 870 MPa, no more than 860 MPa, no more than 850 MPa, no more than 840 MPa, no more than 830 MPa, no more than 820 MPa, or no more than 810 MPa. As such, the yield strength of the nanocrystalline titanium alloy may be 860 MPa to 1100 MPa, 900 MPa to 1100 MPa, 1000 MPa to 1110 MPa, or 1050 MPa to 1100 MPa. The apparatus, methods, and articles of manufacture described herein are not limited in this regard.

According to one aspect, the nanocrystalline titanium alloy may be associated with a modulus of elasticity or Young's modulus of about 110 Gigapascal (GPa) to about 120 GPa. The modulus of elasticity is the linear slope on a plot of stress (ordinate) versus strain (abscissa). The greater the modulus, the stiffer is the material. In some embodiments, the nanocrystalline titanium alloy may be associated with a modulus of elasticity of at least 110 GPa, at least 111 GPa, at least 112 GPa, at least 113 GPa, at least 114 GPa, at least 115 GPa, at least 116 GPa, at least 117 GPa, at least 118 GPa, or at least 119 GPa. In further embodiments, the nanocrystalline titanium alloy may be associated with a modulus of elasticity of no more than 120 GPa, no more than 119 GPa, no more than 118 GPa, no more than 117 GPa, no more than 116 GPa, no more than 115 GPa, no more than 114 GPa, no more than 113 GPa, no more than 112 GPa, or no more than 111 GPa. The apparatus, methods, and articles of manufacture described herein are not limited in this regard.

According to one aspect, the nanocrystalline titanium alloy may be associated with percent elongation of about 6.0% to about 6.2%. Percent elongation is the percentage of plastic strain at fracture. In some embodiments, the nanocrystalline titanium alloy is associated with percent elongation of at least 6.0% or at least 6.1%. In further embodiments, the nanocrystalline titanium alloy may be associated with percent elongation of no more than 6.2% or no more than 6.1%.

Figure 3:
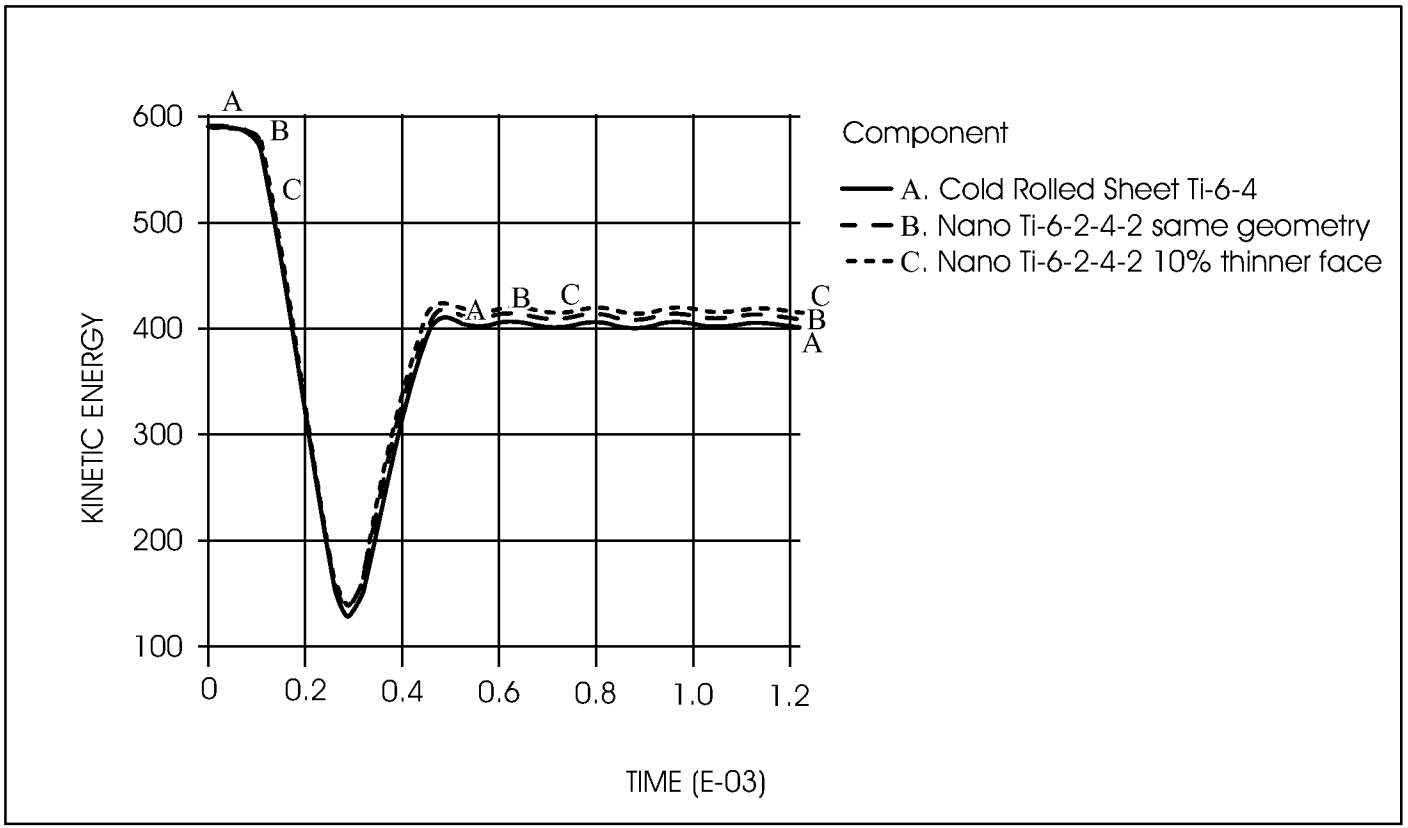
FIG. 3 is graph plotting the calculated kinetic energy of a ball after impacting some embodiments of the golf club head of FIG. 1 in comparison to the kinetic energy after impacting a conventional golf club head.

According to one aspect, the golf club head 12 is associated with a coefficient of restitution of about 0.847 or more when a ball impacts the ball-striking face 16. In some embodiments, the golf club head 12 may be associated with a coefficient of restitution of at least 0.847, at least 0.848, at least 0.849, at least 0.850, at least 0.851, at least 0.852, at least 0.853, or at least 0.854. In particular, the coefficient of restitution may be calculated by an outward ball speed of the ball after the impact divided by an incident ball speed of the ball before the impact. Referring to FIG. 3, the coefficient of restitution may be calculated by simulating a kinetic energy of the ball before and after impact. By way of example only, the kinetic energy of the ball relates to the ball speed as follows:

$$E=\tfrac{1}{2}mv^2 \qquad [2]$$

where E is the kinetic energy, m is the mass, and v is the speed of the ball. Thus, a higher kinetic energy after impact indicates a higher outward ball speed, which results in a higher coefficient of restitution. The coefficient of restitution can depend on the ball incident speed before the impact and various aspects of the ball-striking face 16 including, but not limited to, the geometrical shape (e.g., the thickness), and the properties of the material. In the illustrated embodiments, the golf club head 12 is associated with a coefficient of restitution of about 0.840 or more when a ball impacts the ball-striking face 16 at an incident ball speed of about 180 kilometers (km) per hour to about 200 km per hour. The apparatus, methods, and articles of manufacture described herein are not limited in this regard.

As described above, the nanocrystalline titanium alloy may be stronger compared to other golf club head materials so that the ball-striking face 16 may be relatively thinner. In some embodiments, the thickness of the ball-striking face 16 may be reduced by about 10% to about 15% compared to a golf club head made out of other materials. The reduced thickness of the ball-striking face 16 in turn may reduce the weight of the golf club head 12 so that discretionary weight may be suitably placed elsewhere for enhancing the performance of the golf club 10. For example, moving weight away from the ball-striking face 16 may move the center of gravity for the golf club 10 toward the direction of the shaft 14. The moved center of gravity may result in adding dynamic loft when an individual uses the golf club 10. The dynamic loft in turn may increase the launch angle of the golf club 10. The launch angle may be the angle at which the ball is projected into the air from the golf club relative to the ground. An increased launch angle may result in the maximum amount of distance traveled by the ball. In short, the thinner ball-striking face 16 made from the nanocrystalline titanium alloy may increase in the amount of discretionary weight to be redistributed to assist in producing the maximum amount of distance traveled by the ball.

The reduced thickness of the ball-striking face 16 may also allow the ball-striking face 16 to bend more to increase the ball speed of the ball after the impact. When the golf club head 12 makes contact with the ball, the kinetic energy from the golf club 10 is transferred to the ball. The amount of energy transferred may correspond to the initial velocity of the ball according to equation [2]. As illustrated in FIG. 3, the calculated kinetic energy of the ball after impacting embodiments of the golf club head 12 may be higher in comparison to the kinetic energy after impacting a golf club head without a ball-striking face made of a nanocrystalline titanium alloy. When the golf club head 12 hits a golf ball, the ball compresses and energy is lost. The compression and recovery rate of the ball may be associated with a natural frequency. If the ball-striking face 16 deforms at a natural frequency close to that of the golf ball's compression and recovery rate, the deformation of the ball-striking face 16 may compensate for some of the energy typically lost when the ball deforms. Increasing the deformation of the ball-striking face 16 may cause the deformation of the ball to decrease, which may improve the energy retention for the ball after impact and therefore increase the coefficient of restitution. In this regard, the ball-striking face 16 comprising the nanocrystalline titanium alloys disclosed herein may resemble and operate like a springboard.

The ball-striking face 16 may be associated with a higher outward ball speed for a given ball incident speed. In some embodiments, when a ball impacts the ball-striking face 16 at an incident ball speed of about 164 km per hour, the outward ball speed may be about 139 km per hour or more. In further embodiments, when a ball impacts the ball-striking face 16 at an incident ball speed of about 175 km per hour, the outward ball speed is about 148 km per hour or more. In still further embodiments, when a ball impacts the ball-striking face 16 at an incident ball speed of about 193 km per hour, the outward ball speed is about 162 km per hour or more.

Figure 4:
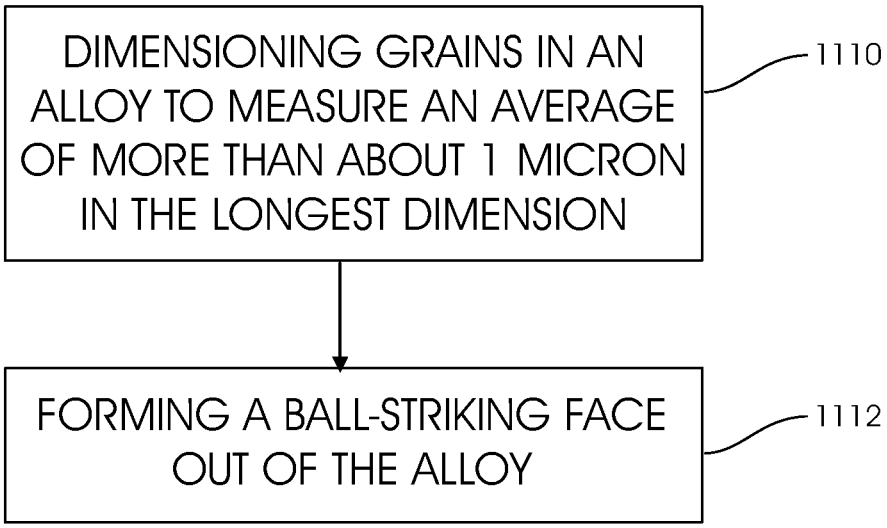
FIG. 4 is a flow chart illustrating a method for manufacturing the golf club head of FIG. 1.

According to one aspect, a method of making the golf club head 12 may generally include dimensioning grains in an alloy to measure an average of no more than about 1 μm in the longest dimension, and forming the ball-striking face 16 out of the alloy. In the example of FIG. 4, a process 1100 may begin with dimensioning grains in an alloy to measure an average of no more than about 1 μm in the longest dimension (block 1110). In some embodiments, dimensioning the grains may comprise dimensioning the grains to measure about 1 nm to about 500 nm in the longest dimension. In further embodiments, dimensioning the grains may comprise subjecting the alloy to equal channel angular pressing. In other embodiments, dimensioning the grains may comprise initially forming a powder of the alloy. In further embodiments, dimensioning the grains may comprise dimensioning grains in an alloy comprising, by weight, about 5.50% to about 6.75% aluminum, about 3.5% to about 4.5% vanadium, and the balance titanium and incidental elements and impurities. In other embodiments, dimensioning the grains may comprise dimensioning grains in an alloy comprising, by weight, about 5.5% to about 6.5% aluminum, about 1.8% to about 2.2% tin, about 3.6% to about 4.4% zirconium, about 1.8% to about 2.2% molybdenum, and the balance titanium and incidental elements and impurities.

At block 1112, the ball-striking face 16 may be formed from the alloy. In some embodiments, forming the ball-striking face 16 may comprise forming the ball-striking face 16 to be associated with a yield strength of about 860 MPa to about 1100 MPa. In further embodiments, forming the ball-striking face 16 may comprise forming the ball-striking face 16 to be associated with a yield strength of about 1050 MPa to about 1100 MPa.

While a particular order of actions is illustrated in FIG. 4, these actions may be performed in other temporal sequences. For example, the actions depicted in FIG. 4 may be performed sequentially, concurrently, or simultaneously. Alternatively, the actions depicted may be performed in reversed order. Further, one or more actions depicted in FIG. 4 may not be performed at all.

Illustrative embodiments of the nanocrystalline titanium alloys are described in greater detail below.

Example 1

Alloy Nano Ti-6-2-4-2

A melt was prepared with a nominal composition of, in weight percentage, about 6% aluminum, about 2% tin, about 4% zirconium, about 2% molybdenum, and the balance titanium and incidental elements and impurities, at FMW Composite Systems, Inc. in Bridgeport, W. Va. A powder of the titanium alloy (called "Nano Ti-6-2-4-2" hereinafter) was initially formed by spray-atomizing the titanium alloy melt. The yield tensile strength, the ultimate tensile strength, modulus, and elongation at break were measured for the powder metallurgy alloy product. The coefficient of restitution was calculated by simulating the kinetic energy of an incident ball before and after impacting a golf club head made out of the Nano Ti-6-2-4-2. In particular, as illustrated in FIG. 3, the coefficient of restitution was calculated for a ball-striking face made out of the Nano Ti-6-2-4-2 having the same thickness as a ball-striking face made out of a cold-rolled sheet titanium alloy with a nominal composition of, in weight percentage, about 6% aluminum, about 4% vanadium, and the balance titanium and incidental elements and impurities (called "regular Ti-6-4" hereinafter). Also, the coefficient of restitution was calculated for a ball-striking face made out of the Nano Ti-6-2-4-2 having a thickness that is about 10% thinner compared to one made out of the regular Ti-6-4.

Example 2

Alloy Nano Ti-6-4

A melt was prepared with a nominal composition of, in weight percentage, about 6% aluminum, about 4% vanadium, and the balance titanium and incidental elements and impurities, at FMW Composite Systems, Inc. A powder of the titanium alloy (called "Nano Ti-6-4" hereinafter) was initially formed by spray-atomizing the titanium alloy melt. The yield tensile strength, the ultimate tensile strength, modulus, and elongation at break were measured for the powder metallurgy alloy product. The coefficient of restitution was calculated by simulating the kinetic energy of an incident ball before and after impacting a golf club head made out of the Nano Ti-6-4.

The following Table 1 summarizes the yield tensile strength, ultimate tensile strength, modulus, and elongation at break of the examples set forth above, compared to the regular Ti-6-4 and a conventional as-cast alloy with a nominal composition of, in weight percentage, about 8% aluminum, 1% molybdenum, 1% vanadium, and the balance titanium and incidental elements and impurities (called "regular Ti-8-1-1" hereinafter).

TABLE 1

| | Average yield tensile strength (ksi) | Average ultimate tensile strength (ksi) | Average modulus (msi) | Average elongation at break (%) |
|---|---|---|---|---|
| Nano Ti-6-4 | 152.6 | 164.0 | 16.56 | 6.0 |
| Nano Ti-6-2-4-2 | 152.9 | 172.2 | 17.22 | 6.2 |
| Regular Ti-6-4 (sheet metal) | Approximately 130 | 138 | 16.50 | Approximately 10 |
| Regular Ti-8-1-1 | Approximately 115 | 130 | 17.4 | Approximately 14 |

The following Table 2 summarizes the simulations of the coefficient of restitution for regular Ti-6-4, Nano Ti-6-2-4-2 with regular geometry, and Nano Ti-6-2-4-2 with a 10% thinner face. The golf club head made out of Nano Ti-6-2-4-2 is associated with a consistently higher coefficient of restitution compared to that made out of regular Ti-6-4, at various incident ball speeds.

TABLE 2

| Incident ball speed (miles/hour) | Alloy used for strike face and geometry | Outward ball speed (miles/hour) | Outward/ incident ratio (CoR) |
|---|---|---|---|
| 120 | Regular Ti-6-4 sheet | 100.27 | 0.8356 |
| | Nano Ti-6-2-4-2 | 101.23 | 0.8436 |
| | Nano Ti-6-2-4-2 with 10% thinner face | 101.71 | 0.8476 |
| 109 | Regular Ti-6-4 sheet | 91.69 | 0.8411 |
| | Nano Ti-6-2-4-2 | 92.22 | 0.8460 |
| | Nano Ti-6-2-4-2 with 10% thinner face | 92.87 | 0.8520 |
| 102 | Regular Ti-6-4 sheet | 86.33 | 0.8463 |
| | Nano Ti-6-2-4-2 | 86.46 | 0.8477 |
| | Nano Ti-6-2-4-2 with 10% thinner face | 87.16 | 0.8545 |

It should be understood from the foregoing that, while particular embodiments have been illustrated and described, various modifications can be made without departing from the spirit and scope of the disclosure as will be apparent to those skilled in the art. Such changes and modifications are within the scope and teachings of this disclosure as defined in the claims appended hereto.

What is claimed is:

1. A golf club head comprising:

at least one ball-striking face, wherein the ball-striking face comprises a titanium alloy with an average grain size measuring less than 1 μm in the longest dimension, the golf club having a coefficient of restitution of about 0.847 or more when a ball impacts the ball-striking face, wherein the titanium alloy has a yield strength of about 860 MPa to about 1100 MPa, and wherein the titanium alloy comprises, about 5.5% to about 6.75% aluminum, about 1.8% to about 2.2% tin, about 3.6% to about 4.4% zirconium, molybdenum, and the balance titanium and incidental elements and impurities.

2. The golf club head of claim 1, wherein the titanium alloy comprises, by weight, at least 1.8% molybdenum.

* * * * *